US010368618B2

(12) United States Patent
Richards et al.

(10) Patent No.: US 10,368,618 B2
(45) Date of Patent: Aug. 6, 2019

(54) WALLET

(71) Applicant: Nomatic, LLC, Salt Lake City, UT (US)

(72) Inventors: Jon Richards, Salt Lake City, UT (US); Jacob Durham, Salt Lake City, UT (US)

(73) Assignee: Nomatic, LLC, Salt Lake City, UT (US)

( * ) Notice: Subject to any disclaimer, the term of this patent is extended or adjusted under 35 U.S.C. 154(b) by 260 days.

(21) Appl. No.: 15/237,882

(22) Filed: Aug. 16, 2016

(65) Prior Publication Data

US 2017/0086547 A1 Mar. 30, 2017

Related U.S. Application Data

(60) Provisional application No. 62/234,006, filed on Sep. 28, 2015.

(51) Int. Cl.
*A45C 11/18* (2006.01)
*A45C 1/06* (2006.01)

(52) U.S. Cl.
CPC ..... *A45C 1/06* (2013.01); *A45C 11/182* (2013.01); *A45C 2001/065* (2013.01)

(58) Field of Classification Search
CPC ..... A45C 1/06; A45C 11/182; A45C 11/18; A45C 2001/065; B42F 7/06
USPC ..... 150/147, 131, 132, 136, 137; 224/218, 224/219, 222, 250; D3/218
See application file for complete search history.

(56) References Cited

U.S. PATENT DOCUMENTS 2,748,821 A * 6/1956 Hutchinson ..... A45C 1/06 150/139
3,589,505 A * 6/1971 Burniski ..... A24F 15/12 206/248
4,541,556 A * 9/1985 Collins ..... B26B 29/025 206/250
4,982,885 A * 1/1991 Severson ..... A45C 13/30 224/250
5,104,076 A * 4/1992 Goodall, Jr. ..... A45F 5/02 224/251
5,535,928 A * 7/1996 Herring ..... A45F 5/02 224/250
6,076,789 A * 6/2000 Jackson ..... A45F 5/02 224/901.4
D739,138 S * 9/2015 Hamilton ..... D3/218
D752,858 S * 4/2016 Hamilton ..... D3/218
9,609,927 B2 * 4/2017 Whichel ..... A45C 13/02
(Continued)

*Primary Examiner* — Fenn C Mathew
*Assistant Examiner* — Cynthia F Collado
(74) *Attorney, Agent, or Firm* — Durham Jones & Pinegar, P.C., Intellectual Property Law Group

(57) ABSTRACT

System and method of storing cards for ease of carrying and access by a user. The system, which may be a wallet, may include a sleeve or band that tightly holds or maintains a card or plurality of cards. The sleeve may have an opening at the top and at the bottom to allow for cards to be positioned within the sleeve. A pull-strap may be coupled to the sleeve and weave through the sleeve in an S-shape to create a first pocket for cards and a second pocket for cards. The pull-strap may pass through a guide in the body of the sleeve that can be pulled or actuated to allow for easy retrieval of the cards from the pockets. The pull-strap and cards can be easily retracted within the sleeve with a single hand of a user.

15 Claims, 12 Drawing Sheets

(56) References Cited

U.S. PATENT DOCUMENTS

| | | | | |
|---|---|---|---|---|
| 2009/0094795 | A1* | 4/2009 | Lazarus | A45C 1/02<br>24/3.12 |
| 2014/0263520 | A1* | 9/2014 | Hamilton | A45F 5/021<br>224/660 |
| 2017/0135452 | A1* | 5/2017 | Kane | A45C 1/06 |

* cited by examiner

WALLET

CROSS-REFERENCE TO RELATED APPLICATIONS

This application claims priority to U.S. Provisional Patent Application No. 62/234,006 entitled WALLET filed Sep. 28, 2015, which is incorporated herein by reference in its entirety.

FIELD

This disclosure relates generally to a money or card carrying device and, more specifically, a wallet for easy access to credit cards, driver's license or similar cards. The wallet may allow a user to more easily withdraw a card from the "slot" that holds the card by utilizing a pull or tab to aid in retrieving the card or cards.

RELATED ART

Wallets are known and have been used for carrying credit cards, driver's license(s), money or cash and many other things, including membership cards, identification cards, rewards cards, and even pictures. Wallets have been used by both males and females. Wallets have taken on many different shapes and sizes and many different features for utilization.

Men's wallets have commonly been marketed with a single or double fold option that allow a user to place the wallet in the pocket of his clothing, such as his pants or jacket. Other wallets have included snaps, buttons, clips, Velcro®, or other means to secure the wallet closed. The wallets are also made of a number of materials and textiles, such as cotton, nylon, polyester, and other cloth. Many wallets are made out of leather or leather-like material. Some newer versions of wallets have included a device made of a type of metal or hard polymer, and the ability to be fully closed. Each of these wallets typically have receptacles, pouches or slots to receive cash or money, credit cards, other cards such as licenses or ID cards and the like.

Women's wallets commonly include at least one fold option as well. These wallets are sometimes longer in length than a typical "men's" wallet. However, like the other wallets described, these wallets typically include the same slot features for holding cash, and cards, and some wallets even comprise a zipper pouch which may often hold coins.

Other devices commonly used are money clips that are able to hold on to cash or cards in a single slot or pouch, placing all the items that are typically held in a wallet in a single location slot or pouch.

The disclosed devices often make it difficult to withdraw cards from the pouches or slots because the devices are attempting to hold tight to the cards and not have them slip out of the slot in which the card resides. In the instance of a money clip or pouch, it is often difficult to withdraw a card because they are too tightly bound by the clip or pouch.

The disclosure provided herein allows a user to more easily withdraw a card, cash, or item of choice from the slot or pouch where it resides. As described herein, the disclosed embodiment will allow a user to pull on a tab or strap pulling the cards out of the slot or pouch for easier access.

SUMMARY

This disclosure, in at least one aspect, relates to the use of a device for carrying cards or money, or a wallet. More generally, a device that provides easier access to cards than a standard money clip or pouch.

The device may include a sleeve or slot to place at least one card inside. The sleeve may allow for a plurality of cards to reside within the sleeve so multiple cards can easily be carried. The sleeve may include a pull tab or strap that, in a first position, allows the cards to be at least partially, and perhaps substantially, covered by the sleeve. The sleeve may be comprised of a single loop or band of material and may have open ends. However, only a single open end is contemplated where the cards are inserted into the sleeve through one opening.

In a second position, a user may pull the tab or strap causing the strap to press against the cards, pulling them outward from the sleeve in the same direction the cards were inserted. The cards may then be at least partially covered by the sleeve and the cards may be covered less than in the first position.

BRIEF DESCRIPTION OF THE DRAWINGS

These and other features, aspects, and advantages of the present disclosure are better understood when the following Disclosure is read with reference to the accompanying drawings.

DETAILED DESCRIPTION

Figure 1:
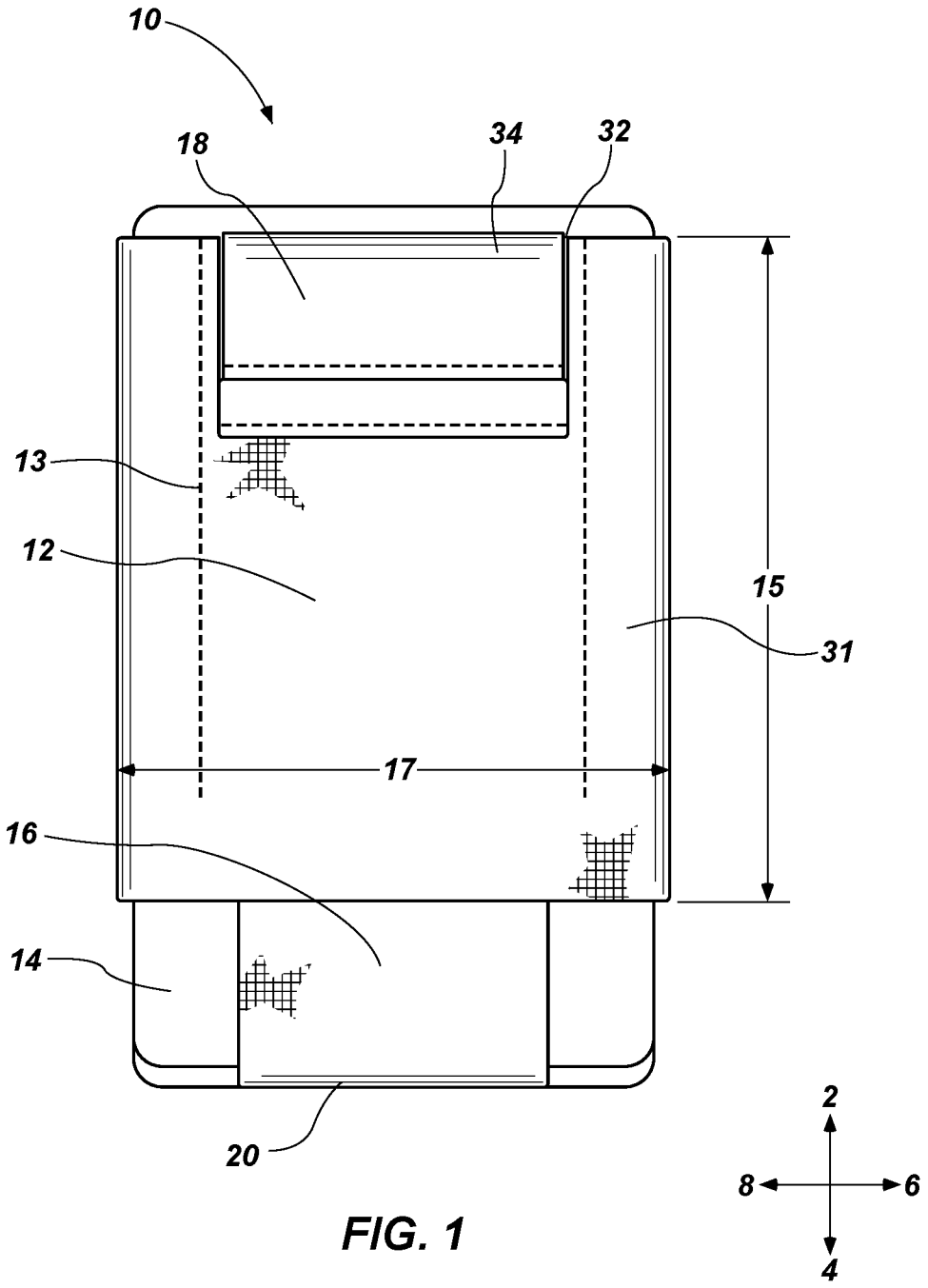
FIG. 1 is a front view of one embodiment of a system or wallet with a sleeve or band.

The following description sets forth separate embodiments of a device, system or wallet (hereinafter "wallet") with a method for the easy removal of cards. The cards may include, for example, credit cards, public transportation cards, driver's license, swipe cards, or any other type of card. Many users, or people, have one or more cards that they use daily or frequently, which may be referred to in the present disclosure as "frequent-use cards." Many users, or people, also have one or more additional cards that they may use less frequently than those of daily use but may still want to carry those cards in their wallets. These less frequently used cards may be referred to in the present disclosure as "occasional-use cards." In some embodiments, the wallet may be configured to store the frequent-use cards in a manner that allows immediate access to the frequent-use cards. In some embodiments, the wallet may also be configured to store the occasional-use cards in a manner that allows easy access to the occasional-use cards.

FIGS. 1-12 may be oriented according to the reference arrow diagram 9, having a superior direction 2 (toward the top of the wallet), an inferior direction 4 (toward the bottom of the wallet), a right lateral direction 6 (toward the right of the wallet), a left lateral direction 8 (toward the left of the wallet), a posterior direction 5 (toward the front of the wallet), and an anterior direction 7 (toward the back of the wallet). In this application, "left" and "right" are used with reference to a posterior view. "Medial" refers to a position or orientation toward a sagittal plane (i.e., plane of symmetry that separates left and right sides of the wallet from each other), and "lateral" refers to a position or orientation relatively further from the sagittal plane.

FIG. 1 illustrates at least one embodiment of a wallet 10 with a sleeve 12, or band, with an interior wall 21, or inner layer, and an exterior wall 23, or outer layer. The sleeve 12 may form a closed loop. The sleeve 12 may hold at least one card 14, or a plurality of cards. The interior wall of the sleeve 12 may firmly hold the card or cards 14 in place within the sleeve 12. The sleeve 12 may be comprised of a material that allows for expansion and retraction such that the cards 14 may fit snugly within the sleeve 12. The material may be nylon, spandex, plastic, rubber, leather, or other expandable or elastic material. The size of the sleeve 12 is variable and may depend on the size of the cards 14 a user desires to carry. The typical size may be that of a standard credit card (which may be 53.98 millimeters by 85.60 millimeters) or driver's license. The length 15 of the sleeve 12 and width 17 of the sleeve 12 may be a first length 15 and first width 17 with cards 14 and a second length 15 and width 17 when no cards 14 reside within the sleeve 12 because of the elasticity of the material. The sleeve 12 may include a first opening 46, or upper opening, disposed toward a superior direction 2 and a second opening 48, or lower opening, disposed toward an inferior direction 4 (refer to FIGS. 8A and 8B).

The wallet 10 may also include a pull-strap 16 with a distal end 18 which may include a pull-tab 34 that extends through a third opening 32, or guide, disposed in a front portion 31 of the sleeve 12 to an exterior of the sleeve 12. The pull-strap 16 may be comprised of similar material as the sleeve 12, with elasticity or alternatively may have little elasticity. In some embodiments, the third opening 32 disposed in the front portion of the sleeve 12 may be formed by coupling an outer layer 23 of the front portion of the sleeve 12 with an inner layer 21 of the front portion of the sleeve 12, as will be described later in further detail. The outer layer 23 of the front portion of the sleeve 12 may be coupled with the inner layer 21 of the front portion of the sleeve 12 in any suitable manner, for example, threading, connecting, attaching, fastening, fitting, or snapping. As depicted in FIG. 1, the outer layer 23 of the front portion of the sleeve 12 may coupled with the inner layer 21 of the front portion of the sleeve 12 via stitching 13. In some embodiments, the distal end 18 may extend upwardly from a first bend 20 in a generally straight and/or planar manner.

Figure 2A:
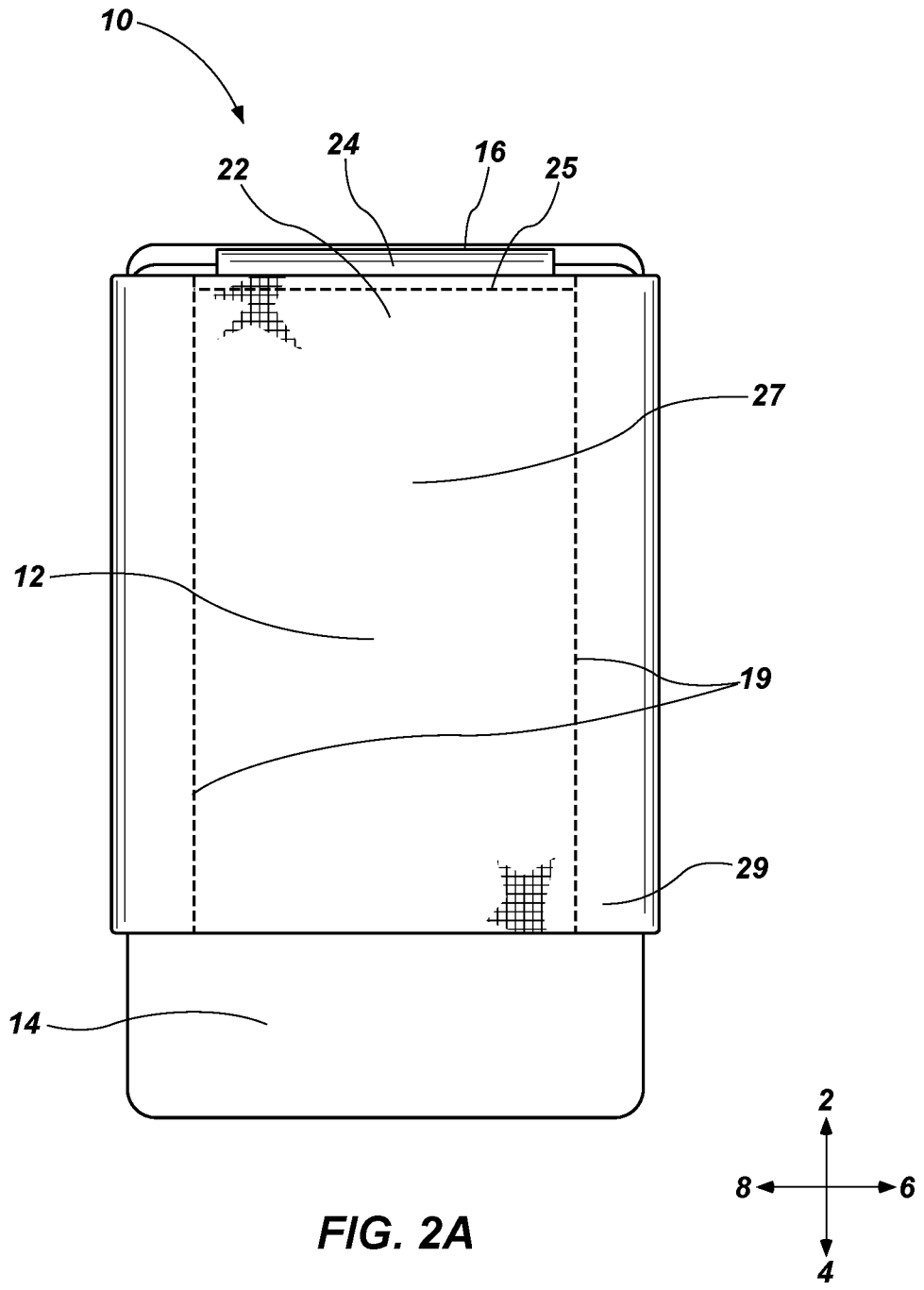
FIG. 2A is a rear view of the system or wallet of FIG. 1.
Figure 2B:
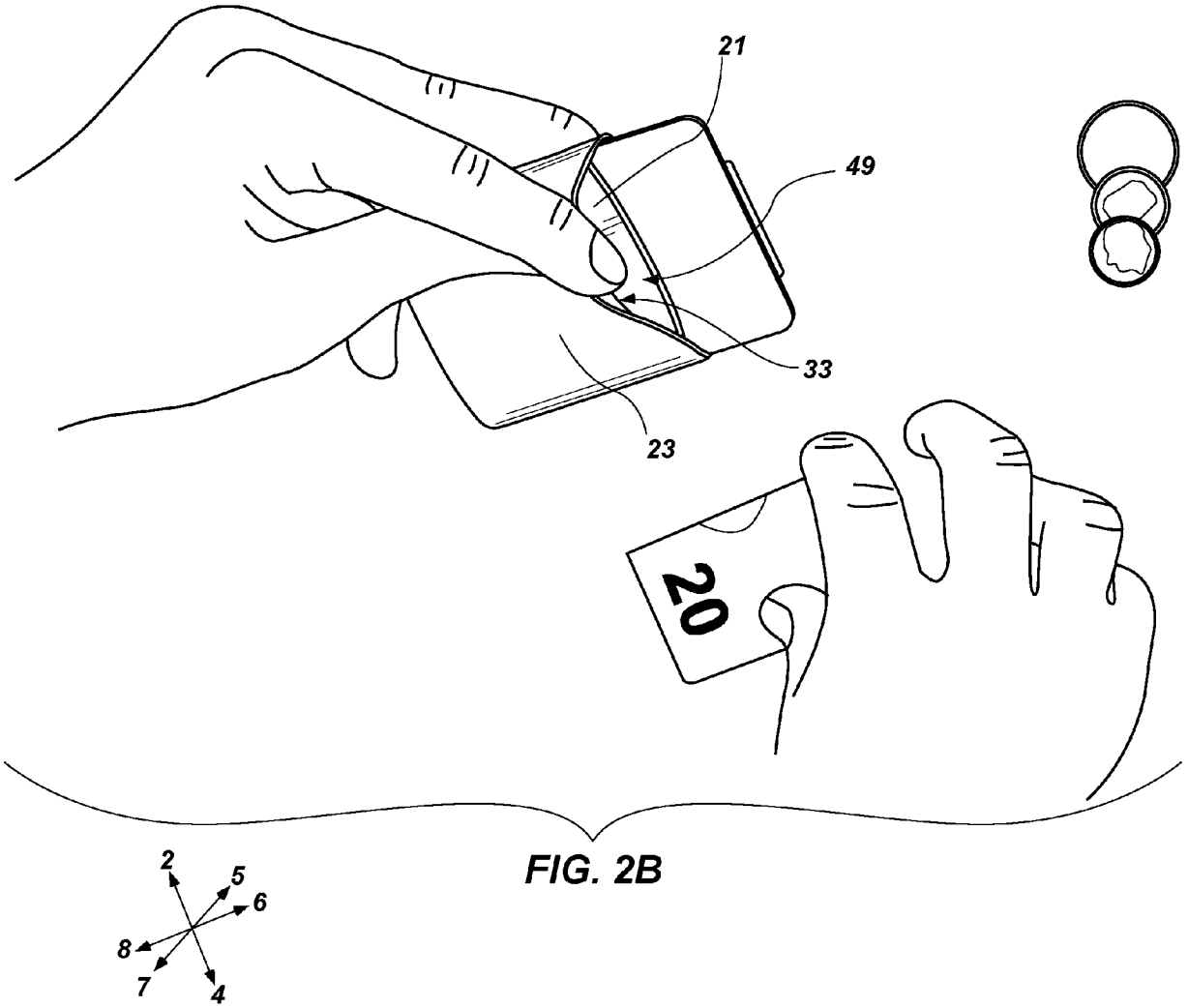
FIG. 2B is a perspective view of the system of wallet of FIG. 1 with a slot or pocket.

Referring to FIGS. 2A and 2B, a rear portion 27, or rear side, or back portion, may include an upper rear portion 22 biased toward a top or superior direction 2 of the wallet 10 and a lower rear portion 29 biased toward a bottom or inferior direction 4 of the wallet 10. A second bend 24 of the pull-strap 16 may be positioned proximate the upper rear portion 22 of the sleeve 12. In some embodiments, the rear portion 27 of the sleeve 12 may include an outer layer 23 and an inner layer 21, or the sleeve 12 may include an outer wall and an inner wall. The outer layer 23 of the rear portion 27 of the sleeve 12 may be coupled to the inner layer 21 of the rear portion 27 of the sleeve 12 along at least a portion of the length 15 of the sleeve 12. The outer layer 23 and inner layer 21 may couple along the entire length 15 of the sleeve 12. The coupling may be through any suitable means including, but not limited to, threading, connecting, attaching, fastening, fitting, snapping, or pressing. In the example in FIG. 2, the outer layer 23 of the rear portion 27 of the sleeve 12 is coupled to the inner layer 21 of the rear portion 27 of the sleeve 12 via stitching 19.

The pull-strap 16 may be coupled to the upper rear portion 22 of the sleeve 12. The second bend 24, which may be proximal end of the pull-strap 16, may be inserted between the outer layer 23 and the inner layer 21 of the rear portion 27 of the band 12. The upper edge of the pocket may be closed or terminate via a suitable manner, such as stitching 25, which may secure the pull-strap 16 of the band 12.

Referring to FIG. 2B, the outer layer 23 and inner layer 21 of the rear portion 27 of the sleeve 12 may form a pocket 33, which may store small items, such as, keys, coins, dollar bills, etc. An opening 49 to the pocket 33 may be positioned toward the lower rear portion 29 of the wallet 10, or biased toward the lower rear portion 29 in an inferior direction 4, but may also be disposed at other locations including the side or top of the wallet 10.

Figure 3:
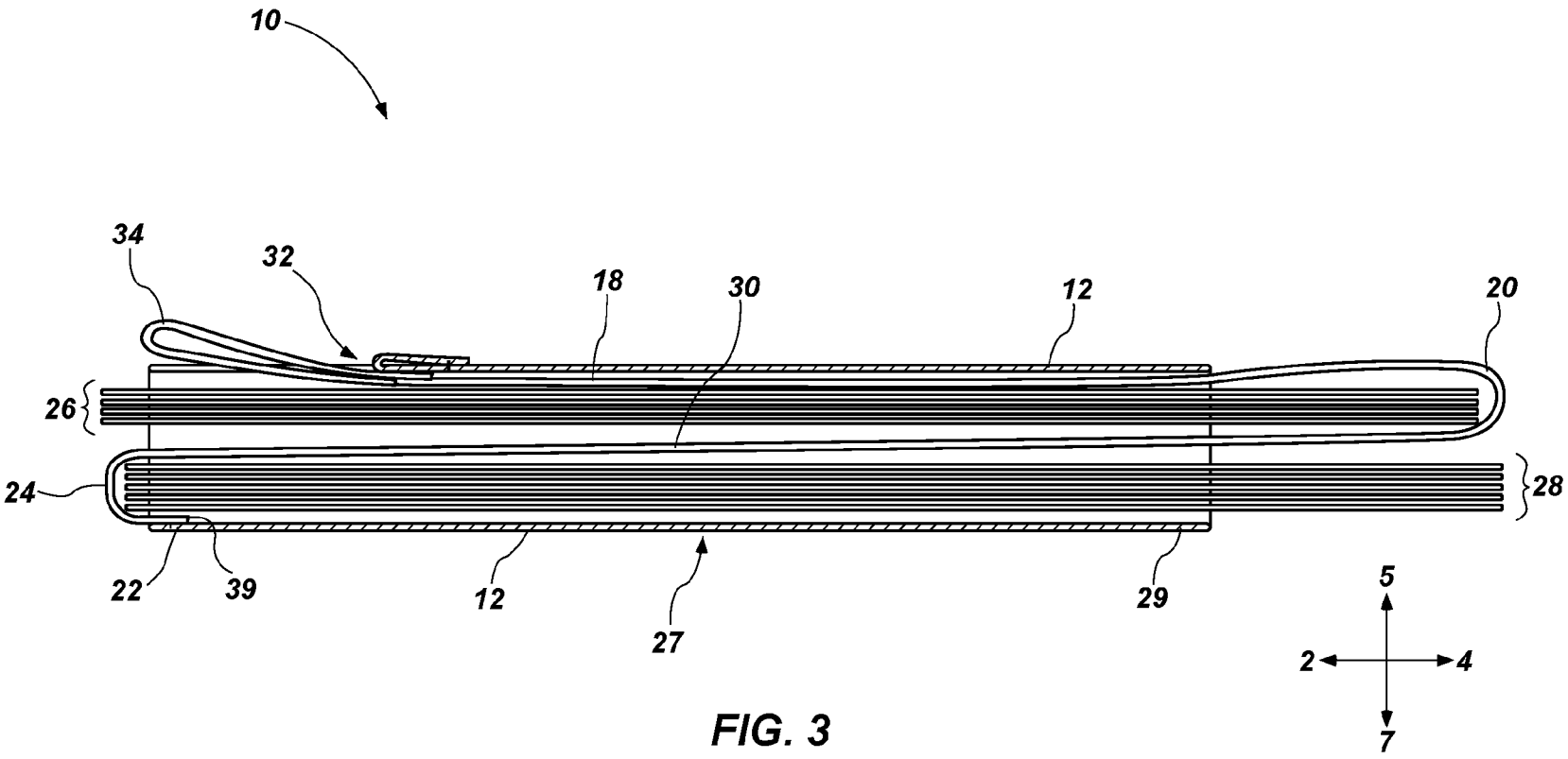
FIG. 3 is a cross-sectional side view of the system or wallet of FIG. 1.
Figure 4:
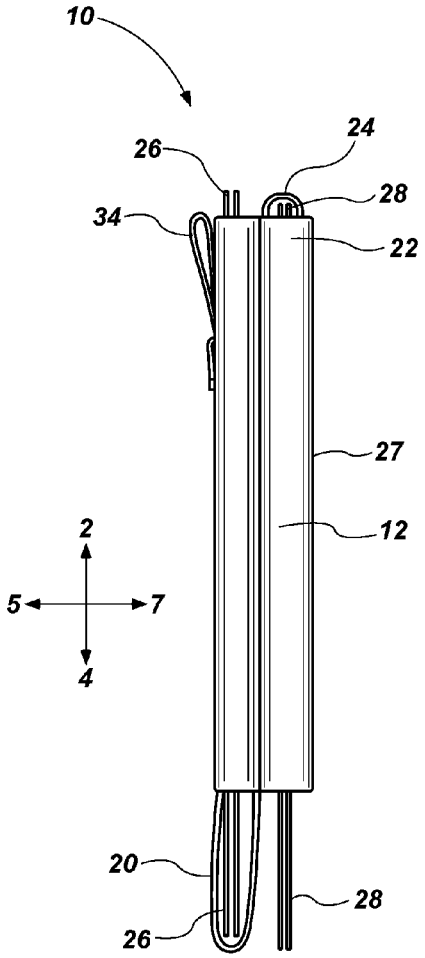
FIG. 4 is a perspective side view of the system or wallet of FIG. 1.

Referring to FIGS. 3 and 4, the pull-strap 16 may be configured to pass through or weave through a first set of cards 26 and a second set of cards 28. An intermediate portion 30 of the pull-strap 16 may be positioned between the first bend 20 and the second bend 24. The first bend 20 may be positioned between the guide 32, or opening, as well as the distal end 18 and the intermediate portion 30. The second bend 24 may be positioned between the intermediate portion 30 and the proximal end or termination end 39, or upper rear portion 22 of the sleeve 12, of the pull-strap 16 which is secured to the sleeve 12. Each of the first bend 20 and second bend 24 may form a substantial U-shape when viewed from a side of the wallet 10. Alternatively the pull-strap 16 may resemble an S-shape configuration.

The distal end 18 of the pull-strap 16 may extend, at least partially, through the guide 32. The distal end 18 may allow ease for a user to actuate or manipulate the pull-strap 16. A pull-tab 34 may be positioned just distal the distal end 18 of the pull-strap 16. The pull tab 34 may be comprised of leather or other durable material (i.e. rubber, plastic, synthetic leather, etc.) that may be secured to the distal end 18 by a suitable means, such as, stitching. The pull-tab 34 may also include a loop of material and may serve multiple purposes, such as preventing the distal end 18 from slipping through the guide 32, ease in actuation of the pull-strap 16, and/or pass through of a finger through the loop of the pull-tab 34 to allow ease in actuation of the pull-strap 16. The pull-tab 34 may be wider in a right direction 6 and left direction 8 than the pull-strap 16 which may also help in preventing the pull-strap 16 from retracting through the guide 32; however, greater width of the pull-tab 34 is not required.

Figure 5:
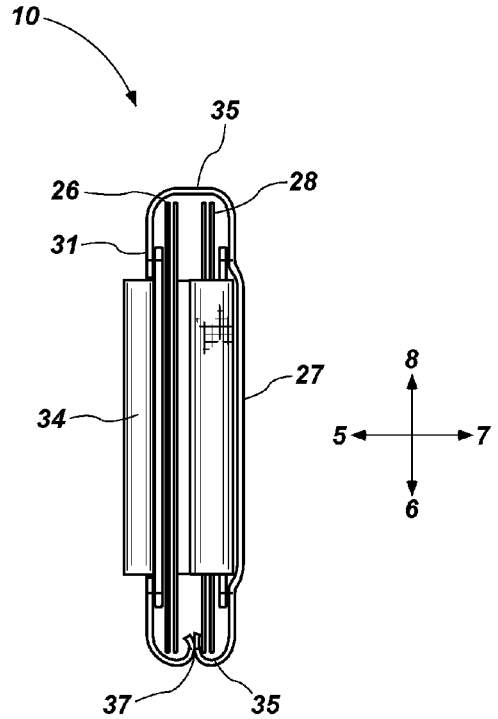
FIG. 5 is a top view of the system or wallet of FIG. 1.
Figure 6:
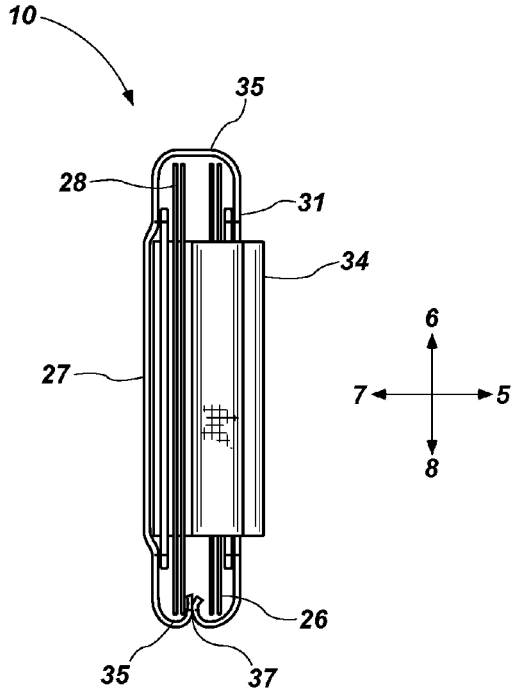
FIG. 6 is a bottom view of the system or wallet of FIG. 1.

Referring to FIGS. 5 and 6, a top view of the wallet 10 is depicted wherein the sleeve 12 may include a front portion 31, or front side, as well as the rear portion 27. The front portion 31 and rear portion 27 of the sleeve 12 may connect on at least one side portion 35. The at least one side portion 35 may comprise a securing feature 37, such as stitching point or seam, to connect the front portion 31 and rear portion 27 and thus create the sleeve 12 of the wallet 10. The sleeve or band 12 may comprise multiple stitching points or securing features 37 at multiple locations along the band 12. Other securing features 37 may be used besides stitching, such as, glue, snaps or the like.

The second bend 24, or a proximal end 39 of the pull-strap 16 at least proximate the second bend 24, may be inserted between the outer layer 23 of the rear portion 27 of the band 12 and the inner layer 21 of the rear portion 27 of the band 12 and secured using any suitable means, such as, for example, threading or stitching. In some embodiments, the first set of cards 26 may be spaced apart from the second set of cards 28 by the pull-strap 16, which may be disposed between the first set of cards 26 and the second set of cards 28.

Figure 7:
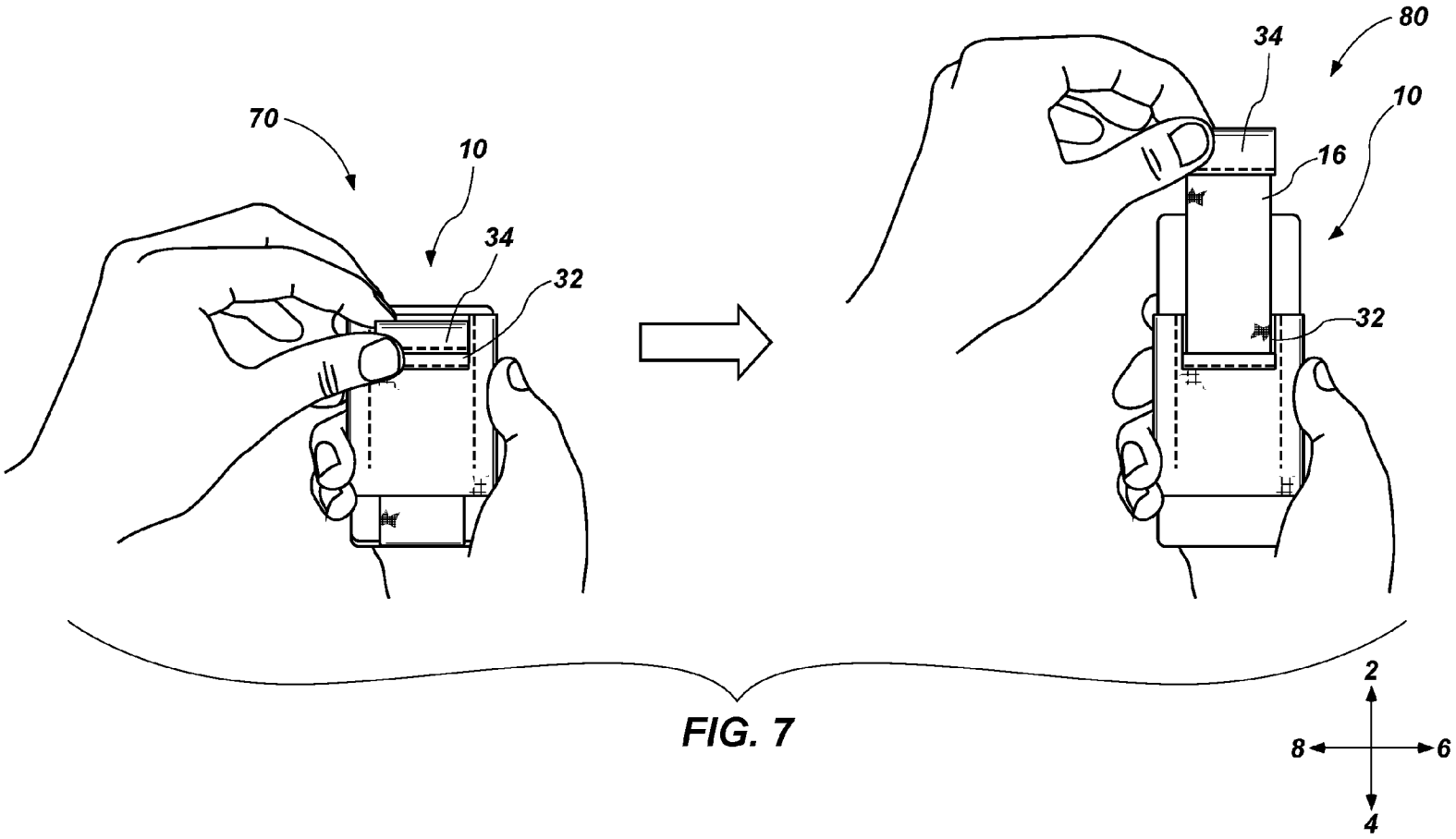
FIG. 7 illustrates movement of a tab and a pull-strap of the system or wallet of FIG. 1 from a first position to a second position.

Referring to FIG. 7, a user is depicted holding the wallet 10 in a first position 70 wherein the pull-strap 16 with the pull-tab 34 is retracted within the wallet 10 through the guide 32. The pull-strap 16 with the pull-tab 34 may be aligned with the upper edge of the sleeve 12. However, the pull-tab 34 may also be positioned just below the upper edge of the sleeve 12 or even slightly above the upper edge of the sleeve 12.

A user may actuate the pull-strap 16 by pulling on the pull-tab 34 in a superior direction 2 to a second position 80 of the wallet 10; however, actuation of the pull-strap 16 may also be pulled by a user in an inferior direction 4 or a posterior direction 5, or any combination of those directions. In the second position 80 the pull-strap 16 the pull-tab 34 may be disposed above an upper edge of the sleeve 12. The pull-strap 16, when in the second position 80, a length of the distal end 18 and/or a length of the pull-strap 16 from the first bend 20 to an upper edge of the pull-tab 34 may be longer than when the pull-strap 16 is in the first position 70. In some embodiments, when the pull-strap 16 is in the second position 80, a length of the intermediate portion 30 may be shorter than when the pull-strap 16 is in the first position 70.

Figure 8A:
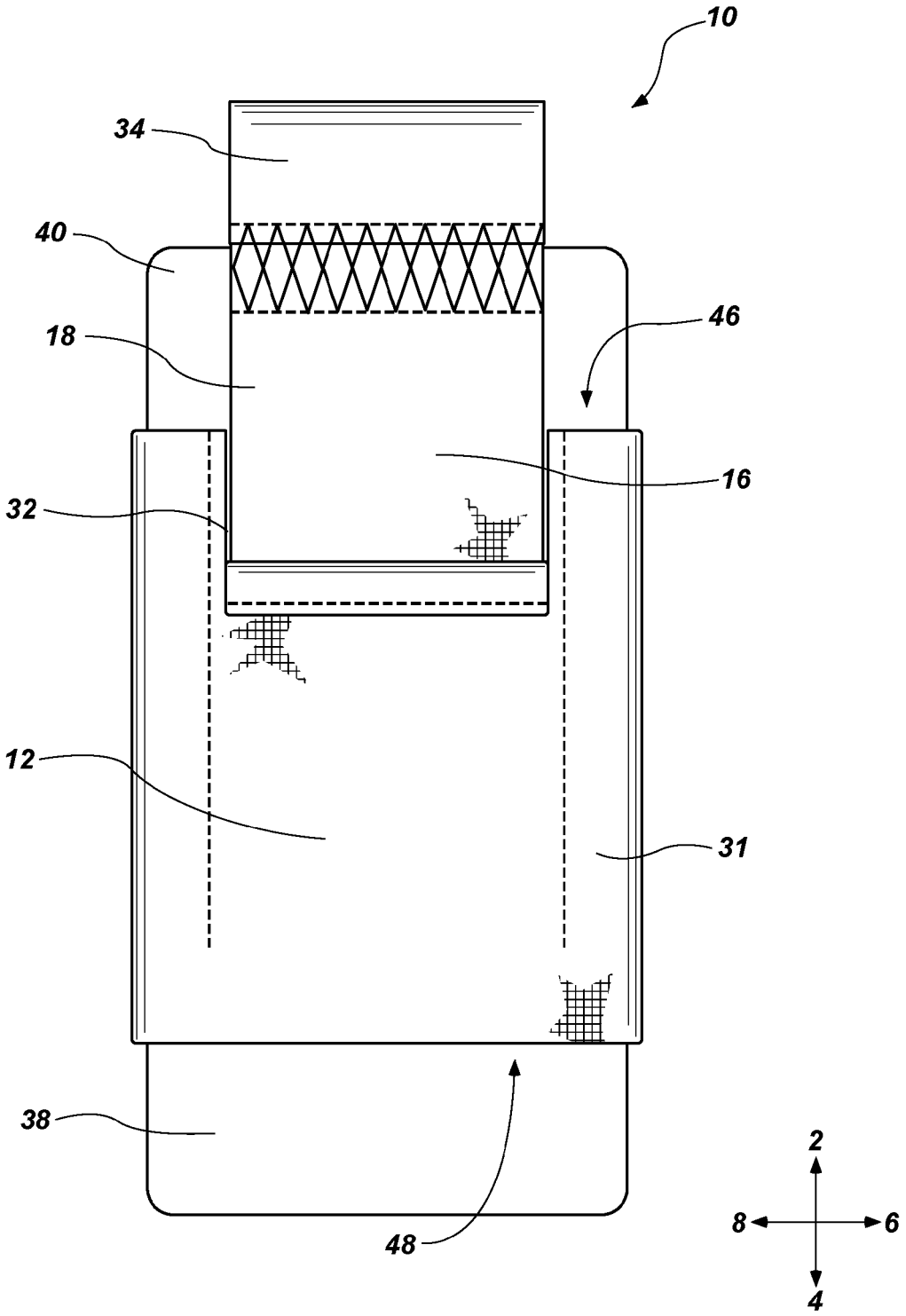
FIG. 8A if the front view of the system or wallet of FIG. 1 with the tab and the pull strap of the system or wallet in the second position.
Figure 8B:
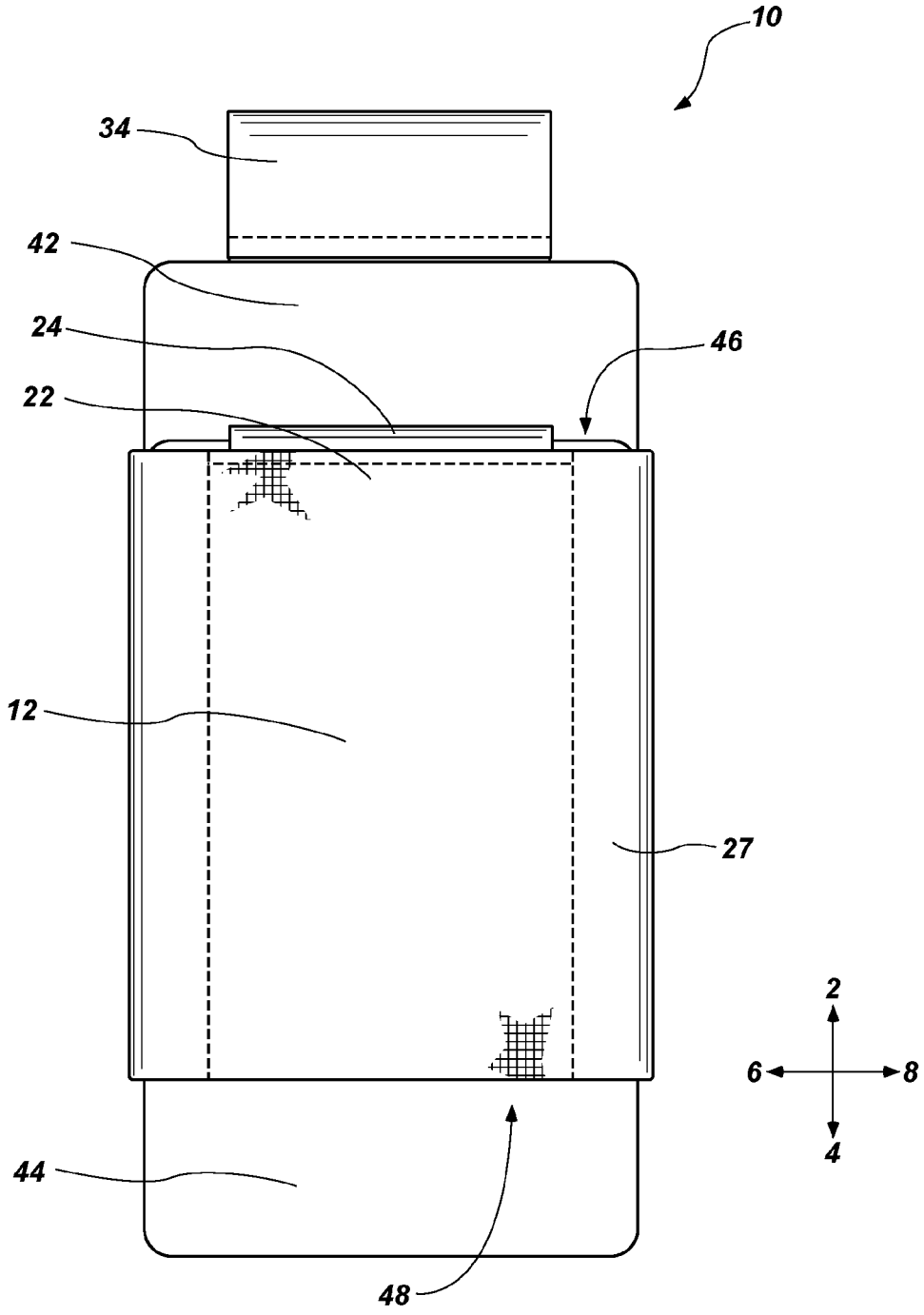
FIG. 8B if the rear view of the system or wallet of FIG. 1 with the tab and the pull strap of the system or wallet in the second position.

FIGS. 8A-8B further illustrate the pull-strap 16 in the second position 80. As illustrated in FIG. 8A, movement of the pull-strap 16 to the second position 80 may expose an inner card 38 of the second set of cards 28 on a front side of the wallet 10, facilitating removal of the inner card 38 from the wallet 10 by the user. Similarly, movement of the pull-strap 16 to the second position 80 may also expose an outer card 40 of the first set of cards 26 on the front side 31 of the wallet 10, facilitating removal of the outer card 40 from the wallet 10 by the user. As illustrated in FIG. 8B, movement of the pull-strap 16 to the second position 80 may also expose an inner card 42 of the first set of cards 26 on the rear side 27 of the wallet 10, facilitating removal of the inner card 42 from the wallet 10 by the user. In some embodiments, an outer card 44 of the second set of cards 28 may be exposed when the pull-strap 16 is in both the first position 70 and the second position 80, facilitating removal of the outer card 44 from the wallet 10 by the user in both the first position 70 and the second position 80. Thus, when the pull-strap 16 is in the second position 80, as many as four cards 14 may be exposed and easily accessed. FIGS. 8A-8B also illustrate the upper opening 46 of the band 12 and the lower opening 48 of the band 12.

Figure 9:
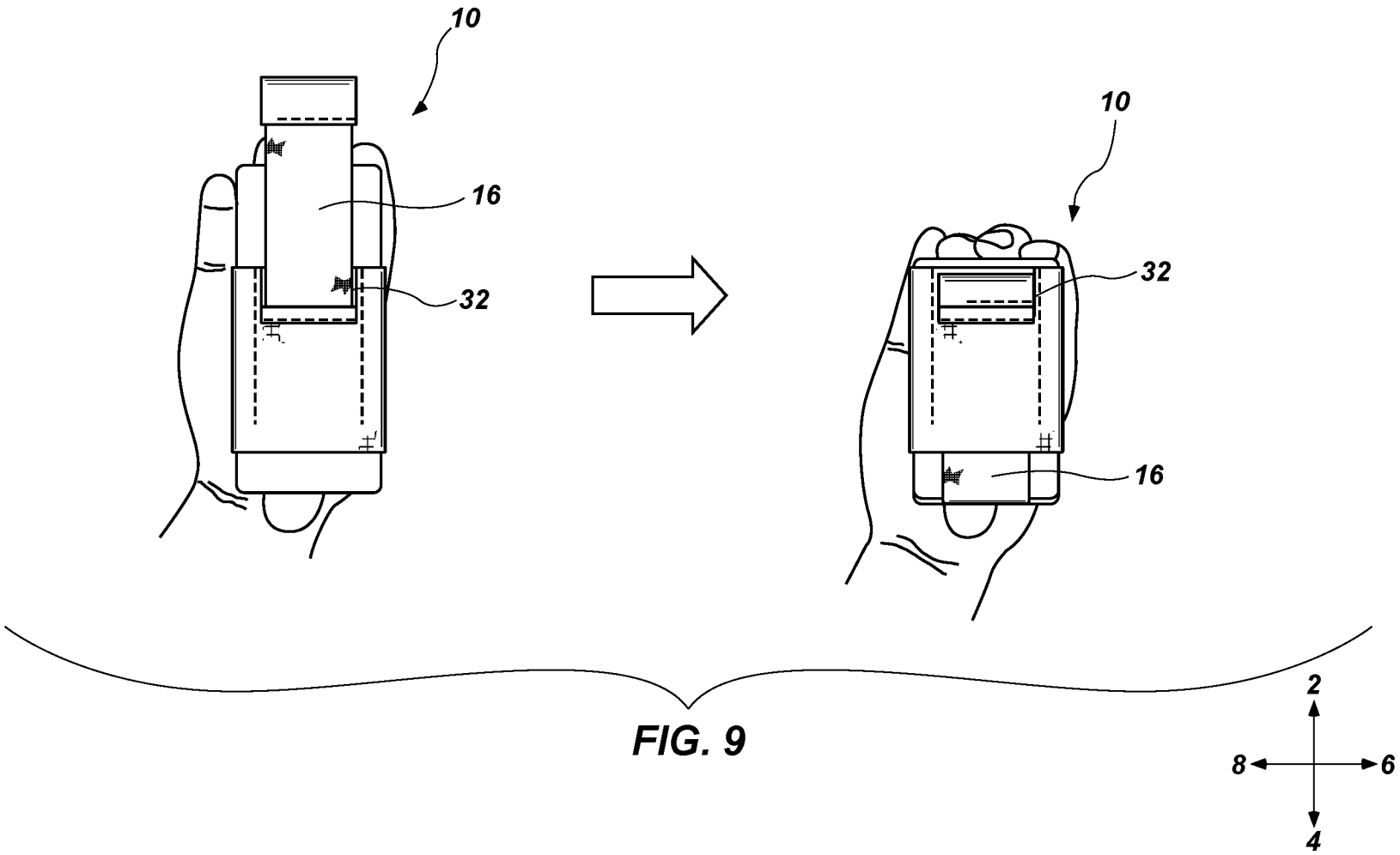
FIG. 9 illustrates movement of the tab and the pull-strap of the system or wallet of in FIG. 1 from the second position to the first position.

Referring to FIG. 9, a user is depicted holding the wallet 10 in a second position 80 wherein the pull-strap 16 with the pull-tab 34 is extended through the guide 32. A user may retract the pull-strap 16 and position the wallet 10 in the first position 70 with the use of a single hand. The movement from the second position 80 to the first position 70 may be accomplished by pushing the first set of cards 26, or just one of the cards 14, through the upper opening 46 in an inferior direction 4. Pushing the first set of cards 26, or just one of the cards 14, in an inferior direction 4 causes the pull-strap 16 to retract through the guide 32, placing the wallet 10 in the first position 70.

Figure 10:
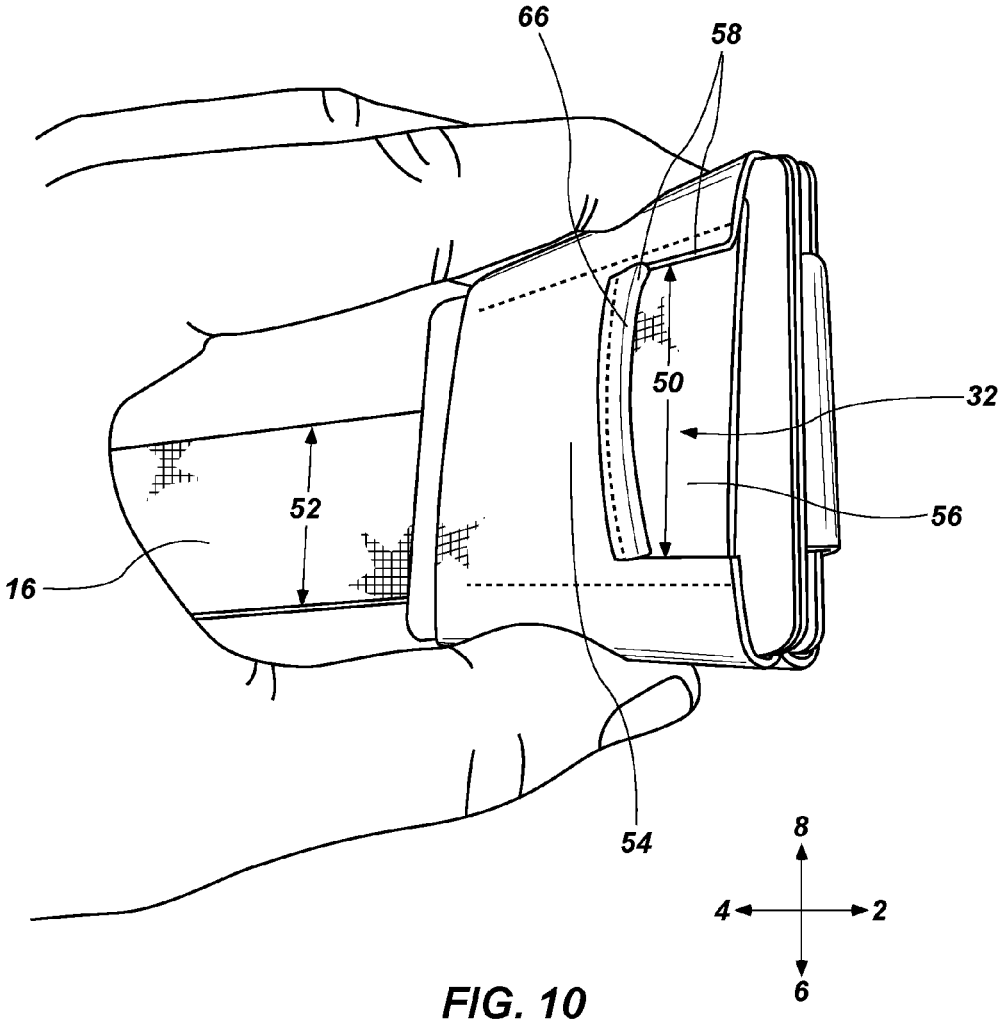
FIG. 10 is a top perspective view of the system or wallet of FIG. 1 with the tab, and the pull-strap, removed from a guide.

Referring to FIG. 10, the pull-strap 16 may be removed from the guide 32, according to some embodiments. A width 50 of the guide 32 may be approximately equal to a width 52 of the pull-strap 16. In some embodiments, the width 50 of the guide 32 and/or the width 52 of the pull-strap 16 may be approximately equal to 1.25 inches but may range from less than one inch to two (2) inches. In alternate embodiments the width 50 of the guide 32 may be slightly larger than the width 52 of the pull-strap 16, allowing the pull-strap 16 to slide freely within the guide 32.

In some embodiments, the guide 32 may be disposed in the front portion 31 of the sleeve 12 and may be formed by coupling a front outer layer 54 of the front portion 31 of the sleeve 12 with a front inner layer 56 of the front portion 31 of the sleeve 12. The front outer layer 54 may include a cut out 58 sized and configured to have similar dimensions to the pull-tab 34, which may allow the wallet 10 to have a slim profile. The distal end 18 of the pull-strap 16 may extend through the guide 32 to an exterior of the sleeve 12. A length of the pull-strap 16 from a point of coupling to the upper rear portion 22 of the sleeve 12 to the upper edge of the pull-tab 34 may be approximately 7.25 inches but may range from three (3) inches to ten (10) inches. The pull-strap 16 may be any length or width, depending, for example, on a size of a particular card or cards the wallet 10 is intended to hold. Furthermore, the guide 32 may include a lip 66 which abuts the cutout 58 wherein the lip 66 may engage the pull-tab 34. The lip 66 may be comprised of the same material as the sleeve 12 or other material, such as leather or the same material as the pull-tab 34 to prevent fraying of the cutout 58 or guide 32. Likewise, similar material may be utilized for the cutout 58 for the same purposes.

Figure 11:
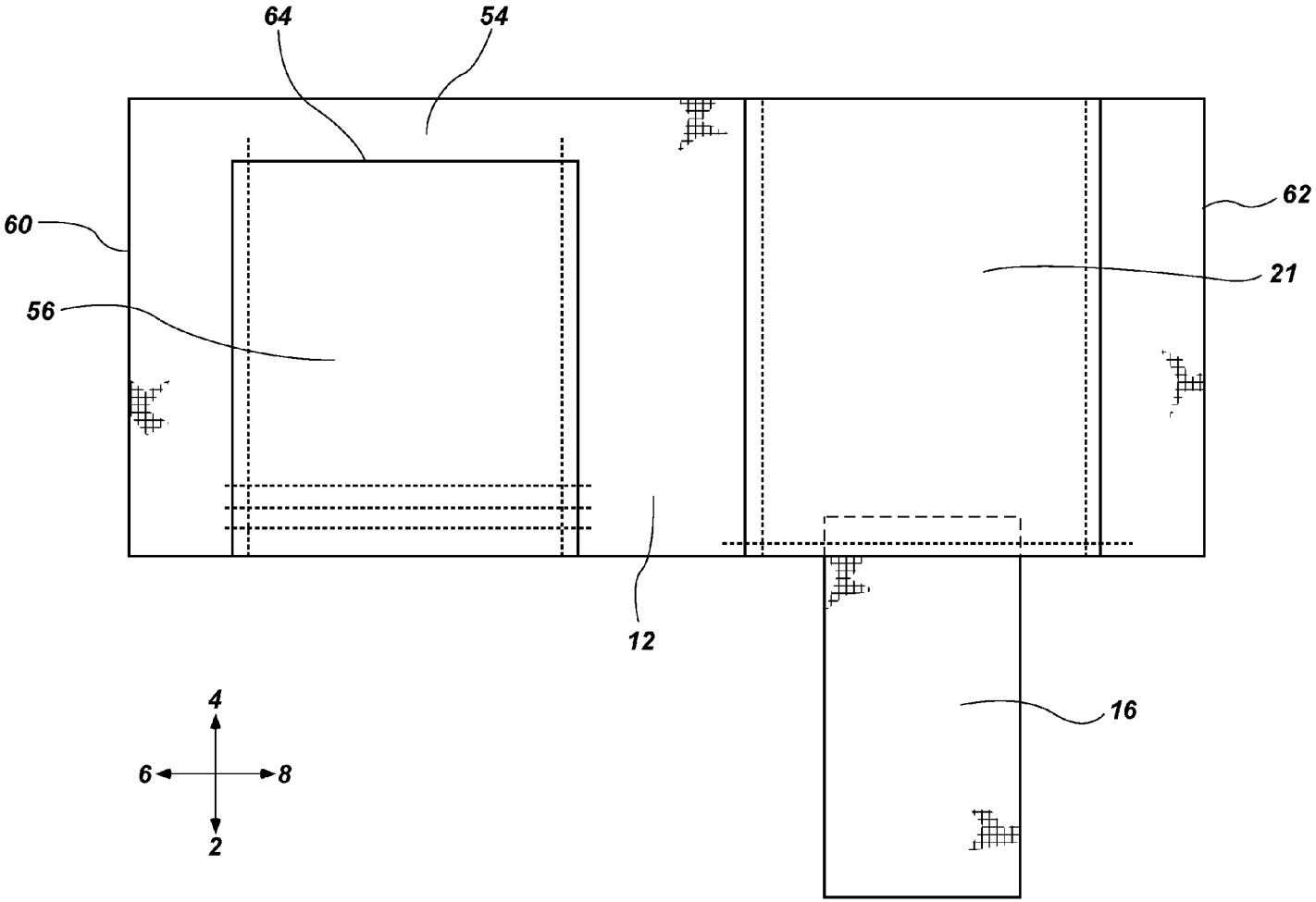
FIG. 11 is a perspective view of the interior of the system or wallet of FIG. 1.

Referring to FIG. 11, a first embodiment that requires a securing feature 37 or seam is depicted. A first end 60 of the sleeve 12 may be coupled with a second end 62 of the sleeve 12 at least along a portion of the length of the first end 60 and second end 62. As set forth previously herein the securing feature 37, which may be stitching, may couple the two ends 60, 62 together. However, any suitable means to connect the first end 60 and second end 62 may be used, such as threading, connecting, attaching, fastening, clipping, snapping, gluing, welding and the like.

The front inner layer 56 of the front portion 31 of the sleeve 12 may be shorter than the outer layer 58 of the front portion 31 of the sleeve 12, which may allow a lower edge 64 (or stop) of the front inner layer 56 to act as a stop. The stop 64 may prevent the pull-strap 16 from extending further than the second position 80.

Alternatively, methods which may be utilized can create the sleeve 12 without seams and without need for a securing feature 37, such as some forms of nylon, plastic, and rubber that allow for a sleeve or band to be manufactured that is enclosed. These alternate means of creating a sleeve (with and without seams) are contemplated herein.

Figure 12:
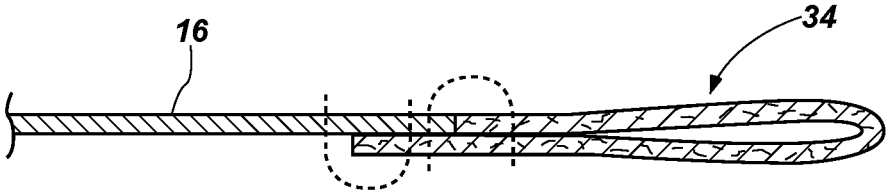
FIG. 12 is a cross-section side view of one method of attaching the tab, of the pull-strap of the system or wallet of FIG. 1, wherein the tab and the pull-strap may comprise different materials.

Referring to FIG. 12, a stitching technique may be depicted which may be used to secure the pull-tab 34 to the pull-strap 16. This and other stitching techniques may also resemble what is depicted in FIG. 8A.

While the present embodiment depicts one or more embodiments for a wallet, alternatives are contemplated herein specifically with regard to dimensions and materials and are considered part of this disclosure.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions, and modifications to the disclosed subject matter that fall within the scopes of the claims are to be embraced thereby. The scope of each claim is indicated and limited only by its plain language and the full scope of available legal equivalents to its elements.

What is claimed:

1. A system comprising:

a sleeve comprising:

a first opening and a second opening opposite the first opening; and a pull-strap coupled to the sleeve, the pull-strap comprising:

a proximal end;

an intermediate portion;

a distal end;

at least one bend;

a third opening in the sleeve, the third opening spaced apart from the first opening and the second opening, wherein the third opening is configured to allow the pull-strap to pass therethrough, wherein the third opening is narrower than the first and second openings, wherein the third opening is at least as wide as the pull-strap; and a front portion and a back portion, wherein the back portion comprises a pocket adjacent to but separate from the second opening.

2. The system of claim 1, wherein the proximal end of the pull-strap is coupled to the sleeve.

3. The system of claim 1, wherein a pull-tab is coupled to the distal end of the pull-strap.

4. The system of claim 1, wherein the pull-strap further comprises a first bend and a second bend positioned on either side with the intermediate portion positioned between the first bend and the second bend.

5. The system of claim 1, wherein each of the first opening and the second opening are configured to receive at least one card in each of the first opening and the second opening in linearly opposite directions.

6. The system of claim 1, wherein the third opening is positioned on the front portion of the sleeve, the third opening comprising a stop to prevent withdrawal of the distal end of the pull-strap through the third opening.

7. The system of claim 1 comprising a first position wherein the distal end of the pull-strap is adjacent to and flush with the first opening of the sleeve.

8. The system of claim 7 comprising a second position wherein the distal end of the pull-strap is displaced from and uneven with the first opening of the sleeve.

9. A wallet comprising:

a band comprising:

a front portion;

a back portion;

and a guide positioned on the front portion of the band, wherein the guide comprises a lip and a cut out in the front portion of the band; and a pull-strap coupled to the band, the pull-strap comprising a proximal end and a distal end, wherein the proximal end is coupled to the band wherein the pull-strap comprises:

the proximal end coupled to the band;

the distal end;

a first bend;

a second bend;

an intermediate portion disposed between the first bend and the second bend;

wherein the pull-strap passes through the guide; and a pull-tab positioned on a distal end of the pull-strap, wherein the pull-tab is coupled to the distal end of the pull-strap, wherein the pull-tab is configured to reside within the cut out, wherein the pull-tab is configured to prevent withdrawal of the distal end of the pull-strap through the guide.

10. The wallet of claim 9 further comprising, a first opening in the band and a second opening in the band opposite the first opening.

11. The system of claim 9, wherein the lip engages the pull-tab to prevent retraction of the distal end of the pull-strap through the guide.

12. The system of claim 10, wherein each of the first opening and the second opening are configured to receive at least one card in each of the first opening and the second opening.

13. A method of actuating a wallet comprising:

positioning a first card in a first opening of the wallet, the wallet comprising a sleeve with the first opening, a second opening opposite the first opening and a guide;

pulling a pull-strap of the wallet, the pull-strap coupled to the sleeve and passing through the guide, the pull-strap comprising:

a proximal end, an intermediate portion and a distal end, a first bend, a second bend, and the intermediate portion disposed between the first bend and the second bend wherein the distal end comprises a pull-tab; and lifting the first card from the first opening of the wallet by pulling the pull-tab.

14. The method of claim 13 further comprising:

pushing a card into the first opening of the wallet;

retracting the pull-strap through the guide; and stopping the pull-strap at a stop in the guide.

15. The method of claim 14 further comprising:

moving the card in the first opening of the wallet with a single hand of a user;

retracting the pull-strap through the guide; and stopping the pull-strap at a stop in the guide.

* * * * *